US008643457B2

(12) United States Patent
Hattori et al.

(10) Patent No.: US 8,643,457 B2
(45) Date of Patent: Feb. 4, 2014

(54) COIL AND METHOD OF FORMING THE COIL

(75) Inventors: Kaoru Hattori, Saitama (JP); Kensuke Maeno, Saitama (JP)

(73) Assignees: Tamura Corporation, Tokyo (JP); Tamura FA System Corporation, Sayama, Saitama (JP)

( * ) Notice: Subject to any disclaimer, the term of this patent is extended or adjusted under 35 U.S.C. 154(b) by 124 days.

(21) Appl. No.: 13/200,926

(22) Filed: Oct. 5, 2011

(65) Prior Publication Data

US 2012/0032771 A1 Feb. 9, 2012

Related U.S. Application Data

(62) Division of application No. 12/449,350, filed as application No. PCT/JP2008/000129 on Feb. 1, 2008, now Pat. No. 8,056,212.

(30) Foreign Application Priority Data

Feb. 5, 2007 (JP) ..... 2007-025251

(51) Int. Cl.
*H01F 27/28* (2006.01)

(52) U.S. Cl.
USPC ..... 336/180

(58) Field of Classification Search
USPC ..... 336/180–184, 220–223, 90, 96
See application file for complete search history.

(56) References Cited

U.S. PATENT DOCUMENTS

| | | | |
|---|---|---|---|
| 1,801,214 | A | 4/1931 | Von Henke |
| 4,617,725 | A | 10/1986 | Holter et al. |
| 7,142,082 | B2 | 11/2006 | Kakehashi et al. |
| 2010/0319802 | A1 | 12/2010 | Hattori |

FOREIGN PATENT DOCUMENTS

| | | | |
|---|---|---|---|
| JP | 57-117217 | | 7/1982 |
| JP | 2000195725 | A * | 7/2000 |
| JP | 2002-57045 | | 2/2002 |
| JP | 2003-124039 | | 4/2003 |
| JP | 2003-133155 | | 5/2003 |
| JP | 2005-93852 | | 4/2005 |
| JP | 3737461 | | 11/2005 |
| JP | 2007134374 | A * | 5/2007 |
| WO | WO 2006/016554 | A1 | 2/2006 |
| WO | WO 2007/132558 | A1 | 11/2007 |

* cited by examiner

*Primary Examiner* — Tuyen Nguyen
(74) *Attorney, Agent, or Firm* — McGinn IP Law Group, PLLC

(57) ABSTRACT

A coil formed by winding one flat type wire material rectangularly edgewise thereby stacking the rectangularly edgewise wound flat type wire in rectangular tube shape, wherein not only one edge of the coil including the flat type wire including an end portion of start-of-winding thereof but also another edge of the coil including the flat type wire including an end portion of finish-of-winding thereof are formed to be projecting from an outer circumference of the coil.

13 Claims, 6 Drawing Sheets

COIL AND METHOD OF FORMING THE COIL

The present Application is a Divisional Application of U.S. patent application Ser. No. 12/449,350, having a §371(c) date of Aug. 4, 2009 now U.S. Pat. No. 8,056,212, which was based on PCT/JP2008/000129 filed on Feb. 1, 2008.

The present application is based on Japanese Patent Application No. 2007-025251, filed on Feb. 5, 2007 the entire contents of which are incorporated herein by reference.

TECHNICAL FIELD

The present invention relates to a coil as an electronic component and a method of forming the coil, in particular to a coil which is preferable for being used as a reactor coil and a method of forming the coil.

BACKGROUND TECHNIQUE

In general, a reactor has, for example, a winding and a core made of a magnetic substance and the winding is wound around the core to make up the coil of the reactor, which enables inductance to be obtained. Conventionally, the reactor is used in a voltage boosting circuit, inverter circuit, active filter circuit, or the like, and, in many cases, such the reactor has a structure in which the core and the coil wound around the core are housed, together with other insulating members or the like in a case made of metal or the like (see, for example, Patent Reference 1). Further, for example, in a reactor to be used in a vehicle-mounted voltage boosting circuit, a coil is used which has a structure in which two single-coil elements each having a predetermined winding diameter and the number of windings that can provide a high inductance value in a high current region are formed in parallel to each other and are coupled (connected) to each other so that the directions of currents flowing through both the coils are reversed to one another (see, for example, Patent Reference 2).

Patent Reference 1: Japanese Patent Laid Open Publication No. 2003-124039

Patent Reference 2: Japanese Patent No. 3737461

DISCLOSURE OF THE INVENTION

Problem to be Solved by the Invention

Winding wires used for a coil is covered by films in order to obtain insulation of the winding wires from each other and insulation thereof from the coil. However, ends of the coil are sometimes connected to the other circuit or the other coil. In such a case, the films covering the ends of the coil are removed. However, in a case of a coil formed by winding a flat type wire material edgewise that is particularly superior in lamination factor, a gap between the coil and a core is narrow. An insulating material is incorporated between the ends of the coil and the core to obtain insulation from the core. Consequently, the number of parts are increased by the insulating material while assembling processes are also increased by thus incorporating process of the insulating material. This therefore causes a problem that production cost of the reactor is increased.

It is an object of the present invention to provide a technique capable of firmly obtaining insulation between the core and the ends of the coil formed by winding a flat type wire material edgewise without using another member for obtaining the insulation.

Means for Solving the Problem

The inventors of the present invention have invented a newly constitutional coil formed by winding a flat type wire material edgewise capable of firmly obtaining insulation between a core and ends of the coil and a method of forming the coil without using another member for obtaining the insulation. Namely, in order to achieve the above object, the coil of the present invention is such a coil that is formed by winding one flat type wire material rectangularly edgewise thereby stacking the rectangularly edgewise wound flat type wire in rectangular tube shape, characterized in that not only one edge of the coil consisting of the flat type wire including an end portion of start-of-winding thereof but also another edge of the coil consisting of the flat type wire including an end portion of finish-of-winding thereof are formed to be projecting from outer circumference of the coil.

With the constitution, not only the end portion of start-of-winding of the coil but also the end portion of finish-of-winding of the coil can be separated by predetermined gaps from a core inserted into the coil. Even if the end portion of start-of-winding of the coil and the end portion of finish-of-winding of the coil are connected, for example, to the other circuit with the films covering the end portions being removed therefrom, insulation of the end portion of start-of-winding of the coil and insulation of the end portion of finish-of-winding of the coil both from the core can be obtained without using another member for obtaining the insulation. As a result, not only cost of parts for preparing the another member but also cost of operations for assembling the another member can be prevented from being increased.

Further, in order to achieve the above object, the method of forming the coil of the present invention is such a method of forming the coil for forming the coil by winding one flat type wire material rectangularly edgewise by the use of a winding head thereby stacking the rectangularly edgewise wound flat type wire in rectangular tube shape, characterized in that the method comprises:

a feeding step of said flat type wire material for preparing said flat type wire material having a length required for said winding of the coil and then feeding the flat type wire material to said winding head, thereby disposing said flat type wire material in a condition that a head of the flat type wire material is projecting by a predetermined length from said winding head;

a start-of-winding step for winding said flat type wire material by the use of said winding head in order that one edge of the coil consisting of the flat type wire including an end portion of start-of-winding thereof may be projecting from outer circumference of the coil;

an wire winding step for winding said flat type wire material by the use of said winding head until the predetermined number of windings immediately before the finish-of-winding of the coil; and a finish-of-winding step for winding said flat type wire material by the use of said winding head in order that another edge of the coil consisting of the flat type wire including an end portion of finish-of-winding thereof may be projecting from outer circumference of the coil.

With the constitution, not only the end portion of start-of-winding of the coil but also the end portion of finish-of-winding of the coil can be separated by predetermined gaps from a core inserted into the coil. Even if the end portion of start-of-winding of the coil and the end portion of finish-of-winding of the coil are connected, for example, to the other circuit with the films covering the end portions being removed therefrom, insulation of the end portion of start-of-winding of the coil and insulation of the end portion of finish-of-winding of the coil both from the core can be obtained without using another member for obtaining the insulation. As a result, not only cost of parts for preparing the another member but also cost of operations for assembling the another member can be prevented from being increased.

Besides, said end portion of start-of-winding of the coil or said end portion of finish-of-winding of the coil in the flat type wire is rendered to be projecting from said outer circumference of the coil by a distance capable of obtaining insulation between the core and said end portion of start-of-winding of the coil or said end portion of finish-of-winding of the coil in said start-of-winding step or said finish-of-winding step.

With the constitution, even if the end portion of start-of-winding of the coil and the end portion of finish-of-winding of the coil are connected, for example, to the other circuit with the films covering the end portions being removed therefrom, insulation of the end portion of start-of-winding of the coil and insulation of the end portion of finish-of-winding of the coil both from the core can be obtained only by the distance between the core and said end portion of start-of-winding of the coil or said end portion of finish-of-winding of the coil.

Furthermore, in order to achieve the above object, the method of forming the coil of the present invention is such a method of forming the coil including at least first and second coil elements each of which is formed by winding one flat type wire material rectangularly edgewise by the use of a first winding head and a second winding head disposed separately from said first winding head by a predetermined distance, thereby each stacking the rectangularly edgewise wound flat type wire in rectangular tube shape, thus forming the coil in such a state as said first and second coil elements are arranged continuously in parallel and winding directions of said first and second coil elements are reverse to each other, characterized in that the method comprises:

a first feeding step of said flat type wire material for preparing said flat type wire material having a length required for both windings of the first and second coil elements and then feeding the flat type wire material from a side of said second winding head to a side of said first winding head and set the flat type wire material around said first winding head, thereby disposing said flat type wire material in a condition that a head of the flat type wire material is projecting by a predetermined length from said first winding head;

a first start-of-winding step of said first coil element for winding said flat type wire material by the use of said first winding head in order that one edge of the first coil element consisting of the flat type wire including an end portion of first start-of-winding thereof may be projecting from outer circumference of the first coil element;

a first wire winding step of said first coil element for winding said flat type wire material by the use of said first winding head until the predetermined number of windings of said first coil element, thereby forming said first coil element;

a second feeding step of said flat type wire material for feeding said flat type wire material having said first coil element formed at a head thereof again from the side of said second winding head to the side of said first winding head;

a forming step of said first coil element for disposing said first coil element in a predetermined posture by bending the whole of said first coil element;

a third feeding step of said flat type wire material for further feeding said flat type wire material from the side of said second winding head to the side of said first winding head in order to save a length of the flat type wire material for winding the second coil element;

a second start-of-winding step of said second coil element for winding said flat type wire material by the use of said second winding head in order that one edge of the second coil element consisting of the flat type wire including an end portion of second start-of-winding thereof may be projecting from outer circumference of the second coil element; and a second wire winding step of said second coil element for winding said flat type wire material by the use of said second winding head until the predetermined number of windings of said second coil element, thereby forming said second coil element.

With the constitution, not only the end portion of start-of-winding of the first coil element but also the end portion of start-of-winding of the second coil element can be separated by predetermined gaps from a core inserted into each of the first and second coil elements. Even if the end portion of start-of-winding of the first coil element and the end portion of start-of-winding of the second coil element are connected, for example, to the other circuit with the films covering the end portions being removed therefrom, insulation of the end portion of start-of-winding of the first coil element and insulation of the end portion of start-of-winding of the second coil element both from the core can be obtained without using another member for obtaining the insulation. As a result, not only cost of parts for preparing the another member but also cost of operations for assembling the another member can be prevented from being increased.

Besides, said end portion of start-of-winding of the first coil element or said end portion of start-of-winding of the second coil element in the flat type wire is rendered to be projecting from said outer circumference of the first coil element or the second coil element by a distance capable of obtaining insulation between the core and said end portion of start-of-winding of the first coil element or said end portion of start-of-winding of the second coil element in said first start-of-winding step or said second start-of-winding step.

With the constitution, even if the end portion of start-of-winding of the first coil element and the end portion of start-of-winding of the second coil element are connected, for example, to the other circuit with the films covering the end portions being removed therefrom, insulation of the end portion of start-of-winding of the first coil element and insulation of the end portion of start-of-winding of the second coil element both from the core can be obtained only by the space (distance) between the core and said end portion of start-of-winding of the first coil element or said end portion of start-of-winding of the second coil element.

Effects of the Invention

According to the present invention, the ends of the coil can be separated by predetermined gaps from the core inserted into the coil. Even if the ends of the coil are connected, for example, to the other circuit with the films covering the ends being removed therefrom, insulation of the ends of the coil from the core can be obtained without using another member for obtaining the insulation. As a result, not only cost of parts for preparing the another member but also cost of operations for assembling the another member can be prevented from being increased.

BEST MODE FOR CARRYING OUT THE INVENTION

A coil of an embodiment of the present invention is described in detail with referring to drawings. According to the embodiment, the coil of the present invention is applied to a coil of a reactor (hereinafter, referred to as a reactor coil). FIG. 1 is a perspective view of a reactor as one example including the reactor coil of the present invention. FIG. 2 is an exploded perspective view of the reactor shown in FIG. 1. The reactor 10 is used for an electrical circuit in a device having, for example, a forcedly cooling means, and includes the reactor coil 12, the reactor core 9, the bobbin 4, the thermal conductive case 1, an insulation/dissipation sheet 7, and the like. As shown in FIG. 1, the reactor 10 has a constitution in which the reactor core 9 is inserted into the reactor coil 12, the reactor coil 12 is housed in the thermal conductive case 1, and a filler 8 is poured therein so as to secure the reactor coil 12. The reactor securing holes 13 formed at four corners of the thermal conductive case 1 are used each as a screw hole to secure the reactor coil 12 to, for example, a forcedly cooled case or the like.

As shown in FIG. 1, the reactor coil 12 has the first coil element 121 and second coil element 122 each formed by edgewise and rectangular winding of the one flat type wire 17 in a manner in which the wound flat type wire 17 is stacked rectangularly and cylindrically (in rectangular tube shape) Here, the term "edgewise winding" denotes a winding way by which the flat type wire 17 is wound vertically. Also, the term "rectangular winding" denotes a winding way by which a coil is wound rectangularly, which is put in contrast with the term "roundly winding". As will later be described in detail, the reactor coil 12 is formed so that a part of the flat type wire 17 constituting one edge 121A of the first coil element 121 including a lead portion 121L formed in an end portion of start-of-winding of the first coil element 121 as well as a part of the flat type wire 17 constituting one edge 122A of the second coil element 122 including a lead portion 122L formed in an end portion of start-of-winding of the second coil element 122 may be separated from the reactor core 9 by distances capable of keeping insulations from the reactor core 9 (hereunder called as insulation distance). Accordingly, even if the lead portions 121L and 122L respectively forming the end portions of the first and second coil elements 121 and 122 are electrically connected to the other electrical component, or the like with film coatings being peeled off and the flat type wire 17 and conductors within the flat type wire 17 being stripped off and provided with pressure connection terminals (not shown) and the like, the lead portions 121L, 122L can be kept insulated from the reactor core 9 without insulation members interposed between the lead portions 121L, 122L and the reactor core 9.

As shown in FIG. 2, the reactor core 9 is made up of two pieces of blocks 3*a* and six pieces of blocks 3*b* each made of a magnetic substance and eight pieces of sheet members 6 to be inserted each as a magnetic gap among the blocks 3*b*. The blocks 3*a* are connected to two straight-line portions consisting of the blocks 3*b* and the sheet members 6, as a result, forming the reactor core 9 having the approximately ring-like shape. The bobbin 4 is made up of a partitioning portion 4*a* and a winding frame portion 4*b* as shown in FIG. 2 and is so configured that the partitioning portion 4*a* can be separated from the winding frame portion 4*b* from the viewpoint of improvement of working efficiency.

In assembling processes of the reactor 10 thus constituted, at first, after the reactor coil 12 is formed, the winding frame portion 4*b* is inserted into the reactor coil 12. The partitioning portion 4*a* is then fitted from both ends of the winding frame portion 4*b*. Then, the blocks 3*b* and the sheet members 6 which constitute straight-line portions of the reactor core 9 are inserted into the winding frame portion 4*b*, thereafter the blocks 3*a* are bonded to the sheet members 6. Thus, the reactor core 9 have two straight-line portions and the reactor coil 12 is formed in each of the straight-line portions with the winding frame portion 4*b* being interposed therein to obtain a specified electrical characteristic. Moreover, the blocks 3*a* of the reactor core 9 are bonded to each of the straight-line portions of the reactor core 9 through the sheet members 6 and, therefore, the blocks 3*a* are so configured as not to be separated.

Next, after the insulation/dissipation sheet 7 is placed on the bottom face of the thermal conductive case 1, the reactor core 9 and reactor coil 12 are housed in the thermal conductive case 1. Further, the filler 8 is poured into the thermal conductive case 1 to secure the reactor cores 9 and reactor coil 12 in the thermal conductive case 1. The insulation/dissipation sheet 7 is placed between the reactor coil 12 and thermal conductive case 1 to provide insulation of both. Moreover, the insulation/dissipation sheet 7 of the embodiment uses the sheet having thermal conductivity being higher than that of the surrounding filler 8 and, therefore, can transfer heat generated from the reactor coil 12 to the thermal conductive case 1 effectively. By this, the heat generated from the reactor coil 12 is dissipated efficiently from the forcedly cooled thermal conductive case 1.

As described above, the reactor 10 has the reactor coil 12 which includes the first coil element 121 and second coil element 122 each formed by edgewise and rectangular winding of the flat type wire 17 in a manner in which the wound flat type wire 17 is stacked rectangularly and cylindrically. Owing to this, the first coil element 121 and second coil element 122 are so formed that the bottom faces are plane and are in contact with the thermal conductive case 1 with the insulation/dissipation sheet 7 interposed therebetween and, therefore, the reactor coil 12 is excellent in a dissipation characteristic compared with the case where coil elements are stacked in layer in a cylindrical manner. Also, similarly, when compared with the case where coil elements are stacked in layer in a cylindrical manner, dead space in the thermal conductive case 1 is reduced, thus enabling the reactor coil 12 to be housed in a case with reduced volume, which serves to make an entire of the reactor be small in size. Further, the reactor coil 12 of the embodiment has the first coil element 121 and second coil element 122 formed by winding the flat type wire 17 edgewisely (vertically) and, therefore, a voltage among wires can be made smaller compared with the case where the flat type wire 17 is wound in a horizontal manner. Accordingly, even in the reactor coil to which a large voltage of 1000 volts is applied, it is possible to ensure high reliability.

FIG. 3 is a perspective view showing the reactor coil 12 shown in FIG. 1 in detail. As shown in FIG. 3, the reactor coil 12 is made up of the first coil element 121 and second coil element 122 each formed by edgewise and rectangular winding of one piece of the flat type wire 17 in a manner in which the wound flat type wire 17 is stacked rectangularly and cylindrically. The first coil element 121 and second coil element 122 are formed so as to be in parallel to each other in a continuous manner and so that the winding directions thereof are reversed to each other. Namely, in the reactor coil 12, in a winding terminating end portion of the first coil element 121 formed by edgewise and rectangular winding of the flat type wire 17 in a manner in which the wound flat type wire 17 is stacked rectangularly and cylindrically, the flat type wire 17 is rendered to be projecting from the first coil element 121 by a coil interval length and bent approximately 90 degrees so that the flat type wire 17 is stacked in a direction (shown by the arrow B in FIG. 3) opposite to the stacking direction (shown by the arrow A in FIG. 3) of the first coil element 121 and is wound edgewisely and rectangularly in a direction opposite to the winding direction of the first coil element 121 and, as a result, in a winding terminating end portion of the second coil element 122, the first coil element 121 and second coil element 122 are arranged in parallel to each other in a continuous manner.

Further, the reactor coil 12 is characterized in that, a part of the flat type wire 17 constituting one edge 121A of the first coil element 121 including the lead portion 121L is rendered to be projecting from outer circumference of the first coil element 121 so that the lead portion 121L formed in an end portion of start-of-winding of the first coil element 121 may be separated from the reactor core 9 by the insulation distance. In addition, the reactor coil 12 is also characterized in that, a part of the flat type wire 17 constituting one edge 122A of the second coil element 122 including the lead portion 122L is rendered to be projecting from outer circumference of the second coil element 122 so that the lead portion 122L formed in an end portion of start-of-winding of the second coil element 122 may be separated from the reactor core 9 by the insulation distance.

Accordingly, even if the lead portions 121L and 122L respectively forming the end portions of the first and second coil elements 121 and 122 are electrically connected to the other electrical component, or the like with film coatings being peeled off and the flat type wire 17 and conductors within the flat type wire 17 being stripped off and provided with pressure connection terminals (not shown) and the like, the lead portions 121L, 122L can be kept insulated from the reactor core 9 without-insulation members interposed between the lead portions 121L, 122L and the reactor core 9.*b* As a result, not only cost of parts for preparing the insulation members as another members but also cost of operations for interposing the insulation members as another members can be prevented from being increased. Moreover, the lead portion 121L of the first coil element 121 and the lead portion 122L of the second coil element 122 is placed on the same side of each of the first and second coil elements 121 and 122 and, therefore, even when unillustrated terminals are mounted to an edge portion of each of the lead portion 121L and 122L, it is possible to align the terminals.

FIGS. 4, 5, and 6 are views for explaining the method of forming the reactor coil 12 shown in FIG. 3. In the method of forming the reactor coil 12, as shown in FIG. 4 (*a*) to FIG. 6(*i*), the winding is performed by using a winding head 100 for the first coil element 121 and a winding head 200 for the second coil element 122. Each of the winding heads 100 and 200 has two head members each like a pulley and each disposed in a manner to face each other with a predetermined interval.

First, as shown in FIG. 4 (*a*), a flat type wire being a wire material (hereinafter, called a flat type wire material 170) is fed to a specified position (first process of feeding the flat type wire material 170). That is, as the winding to be used for the first coil element 121 and second coil element 122, the sufficiently long flat type wire material 170 is prepared and the flat type wire material 170 is then fed from the winding head 200 side to the winding head 100 side, that is, to the direction shown by the arrow A in FIG. 4(*a*) to let the flat type wire material 170 be drawn through the winding head 100 in order to set the position of the flat type wire material 170 so that the tip 170*f* of the flat type wire material 170 protrudes from the winding head 100 having a predetermined length. The flat type wire material 170 is formed by covering a so-called rectangular conductive line with a coating. Moreover, the tip 170*f* of the flat type wire material 170, as will be described later, makes up an end portion of start-of-winding 121*a* of the first coil element 121.

Then, as shown in FIG. 4(*b*), winding is performed to form the first coil element 121 by using the winding head 100 (start-of-winding process and winding process of the first coil element). Each process is one of remarkable features of the method of forming the reactor coil 12 of this embodiment. Namely, winding of the flat type wire material 170 is performed so that a part of the flat type wire material 170 constituting one edge 121A including the end portion of start-of-winding 121*a* of the first coil element 121 may be projecting from the outer circumference of the first coil element 121. Then, the winding is performed to form the first coil element 121 until the predetermined number of windings is reached.

Namely, the flat type wire material 170 is fed (sent) to perform the winding so that a length w (distance between centers of the flat type wire material 170) of another side edge 121B continuously elongated from one side edge 121A of the first coil element 121 shown in FIG. 4(*b*) may be determined by a sum of a length b (distance between centers of the flat type wire material 170) of original another side edge of the first coil element 121 and the insulation distance i. Thereafter, the flat type wire material 170 is wound around the first coil element 121 toward a direction shown by the arrow B in FIG. 4 (*b*), thereby forming the first coil element 121. As shown in FIG. 4(*b*) and later other drawings, the first coil element 121 is formed so as to have a specified dimension in a direction orthogonal to paper in the drawing (in a lower direction or higher direction of paper in the drawing).

After the formation of the first coil element 121, as shown in FIG. 4(*c*), the flat type wire material 170 is again fed (second feeding process of flat type wire material). That is, the tip 170*f* of the flat type wire material 170 is fed to a direction shown by the arrow C in FIG. 4(*c*). At this time, in order to ensure an interval between the first coil element 121 and second coil element 122, the flat type wire material 170 is fed excessively by a predetermined coil interval length T.

As shown in FIG. 4(*d*), the entire first coil element 121 is formed (bent) at 90 degrees. That is, by forming (bending) the flat type wire material 170 at 90 degrees in a direction shown, by the arrow D in FIG. 4 (*d*), the first coil element 121 is set to take a predetermined posture. In this case, at the position where the flat type wire material 170 is protruded from the winding head 100 by the coil interval length T, the flat type wire material 170 is bent 90 degrees by using the winding head 100. That is, by bending the flat type wire material 170 at the position where the flat type wire material 170 is shifted by the specified coil interval length T by using the winding head 100 by 90 degrees, the entire first coil element 121 is formed.

Then, as shown in FIG. 5(*e*), the flat type wire material 170 is further fed (third feeding process of the flat type wire material). The tip 170*f* of the flat type wire material 170 is further fed in a direction shown by the arrow E in FIG. 5 (*e*). In this case, in order to ensure the length of the wire material required for the winding of the second coil element 122, the flat type wire material 170 is fed until the first coil element 121 and flat type wire material 170 are protruded from the winding head 100 over a considerable length. Moreover, according to the embodiment, the flat type wire material 170 is cut after the flat type wire material 170 is pushed out from the supplying source thereof by a sufficient length and the end 170*b* of the flat type wire material 170 formed by the cutting makes up the tip 122*a* of the second coil element 122.

Next, as shown in FIG. 5 (*f*), winding is performed to form the second coil element 122 by using the winding head 200 (start-of-winding process and winding process of the second coil element). Each process is one of remarkable features of the method of forming the reactor coil 12 of this embodiment.

Namely, winding of the flat type wire material 170 is performed so that a part of the flat type wire material 170 constituting one side edge 122A including the end portion of start-of-winding 122*a* of the second coil element 122 may be projecting from the outer circumference of the second coil element 122. Then, the winding of the flat type wire material 170 is performed in a direction reverse to that of the first coil element 121 to form the second coil element 122 until the predetermined number of windings is reached.

Namely, the flat type wire material 170 is fed (sent) to perform the winding so that a length w (distance between centers of the flat type wire material 170) of another side edge 122B continuously elongated from one side edge 122A of the second coil element 122 shown in FIG. 5(*f*) may be determined by a sum of a length b (distance between centers of the flat type wire material 170) of original another side edge of the second coil element 122 and the insulation distance i. Thereafter, the flat type wire material 170 is wound around the second coil element 122 toward a direction shown by the arrow F in FIG. 5 (*f*), thereby forming the second coil element 122. Accordingly, the winding to form the second coil element 122 is performed by using a portion existing between the winding head 200 and winding head 100 of the flat type wire material 170 as shown in FIG. 5 (*f*) and a portion pushed out continuously to the first coil element 121 from the winding head 100 as shown in FIG. 5 (*e*).

Thus, as shown in FIGS. 5 (*e*) and 5(*f*), after the completion of the winding to form the first coil element 121, the flat type wire material 170 is fed by the length required for winding to form the second coil element 122 and then the flat type wire material 170 is rewound in a reverse direction to perform the winding to form the second coil element 122. This method of forming the reactor coil is a big feature of the present embodiment. Thus, as shown in FIG. 5 (*g*), due to the winding to form the second coil element 122, the first coil element 121 is moved to the winding head 200 side, that is, in a direction shown by the arrow G in FIG. 5 (*g*). That is, this means that the coil elements 121 and 122 begin to come near to each other.

Further, as shown in FIG. 6 (*h*), the winding to form the second coil element 122 proceeds and, as a result, the coil elements 121 and 122 come nearer to each other. At this time, as shown in FIG. 6 (*h*), the first coil element 121 is separated from the winding head 100 and comes near to the second coil element 122 in a direction shown by the arrow H in FIG. 6 (*h*). Therefore, it is desirable that the reactor coil 12 has a mechanism of lifting the first coil element 121 so that the first coil element is separated from the winding head 100 upward.

As shown in FIG. 6 (*i*), the winding proceeds from the state of the second coil element 122 shown in FIG. 6 (*h*) further to the state of the winding by a quarter round (90 degrees), thereby completing the formation of the second coil element 122, and thus making the winding of both the coil elements 121 and 122 be completed, which finishes the formation of the reactor coil 12. In this state where the winding has been completed, the end portion 121*a* of the first coil element 121 and the end portion 122*a* of the second coil element 122 are aligned in an extended manner in the same direction as shown in FIG. 6(*i*). Therefore, as shown in FIG. 3, the end portion 121*a* of the first coil element 121 and the end portion 122*a* of the second coil element 122 are bended in a coil axial direction to form the lead portion 121L and the lead portion 122L. Moreover, it is necessary that the completed reactor coil 12 made up of both the coil elements 121 and 122 is separated from the winding head 200 and, therefore, it is desirable that the mechanism of lifting both the coil elements 121 and 122 so that the coil elements 121 and 122 are removed upward is provided.

By using the above forming method, as shown in FIG. 3, the reactor coil 12 can be obtained, in which a part of the flat type wire 17 constituting one side edge 121A of the first coil element 121 including the lead portion 121L and a part of the flat type wire 17 constituting one side edge 122A of the second coil element 122 including the lead portion 122L are rendered to be projecting from outer circumferences of the first coil element 121 and the second coil element 122, respectively, so that the lead portion 121L formed in an end portion of start-of-winding of the first coil element 121 and the lead portion 122L formed in an end portion of start-of-winding of the second coil element 122 may be separated from the reactor core 9 by the insulation distances, respectively.

In the coil of the conventional example mentioned above, an insulation member is interposed between ends of the coil and the core to obtain insulation in order that the ends of the coil may be electrically connected to the other electrical component, or the like by providing the ends of the coil with pressure connection terminals, and the like. In the reactor coil 12 of this embodiment, even if the film coatings of parts of the flat type wire 17 constituting the lead portions 121L and 122L are peeled off and the conductors within the flat type wire 17 are stripped off, the lead portions 121L, 122L can be kept insulated from the reactor core 9 without insulation members interposed between the lead portions 121L, 122L and the reactor core 9. As a result, not only cost of parts for preparing the insulation members as another members but also cost of operations for interposing the insulation members as another members can be prevented from being increased.

Besides, in the embodiment mentioned above, description was made about the reactor coil 12 having two continuous coil elements 121, 122. However, the present invention can be similarly applied to a reactor coil in which two single coils are combined or a reactor coil consisting mainly of a single coil. In such a case, the reactor coil is so formed that a flat type wire constituting one side edge of the coil including an end portion of start-of-winding of the coil as well as a flat type wire constituting another side edge of the coil including an end portion of finish-of-winding of the coil are projecting from outer circumference of the coil.

It is apparent that the present invention is not limited to the above embodiments but may be changed and modified without departing from the scope and spirit of the invention.

INDUSTRIAL APPLICABILITY

The present invention can be widely applied not only to a coil of a reactor but also to coils of other electronic components such as a transformer and the like so long as the coil is formed by winding one flat type wire edgewisely and rectangularly in a manner in which the wound flat type wire is stacked in rectangular tube shape and the ends of the coil are projecting from outer circumference of the coil.

DESCRIPTION OF REFERENCE NUMERALS

Figure 1:
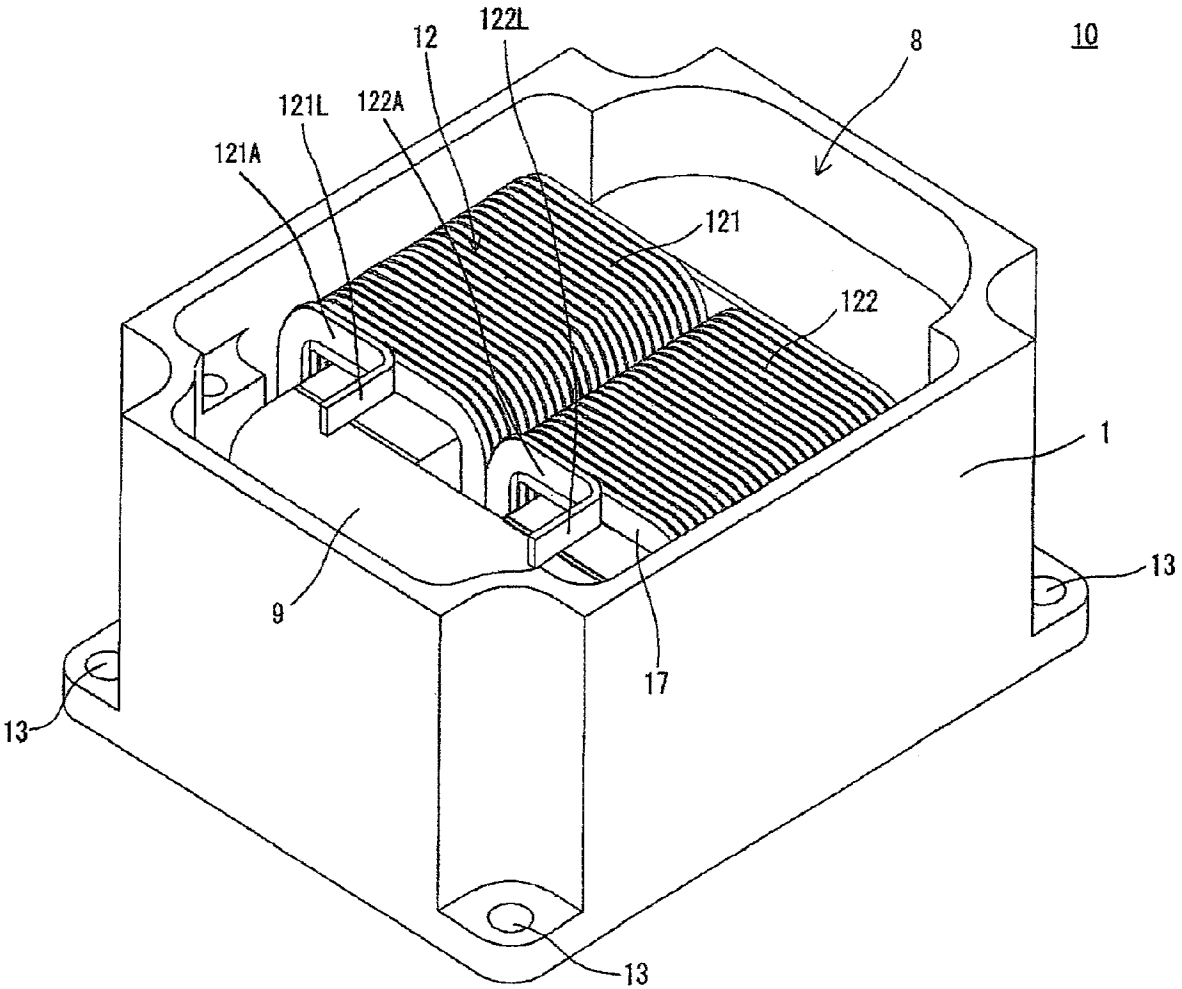
FIG. 1 is a perspective view of one example of a reactor having a coil according to an embodiment of the present invention.
Figure 2:
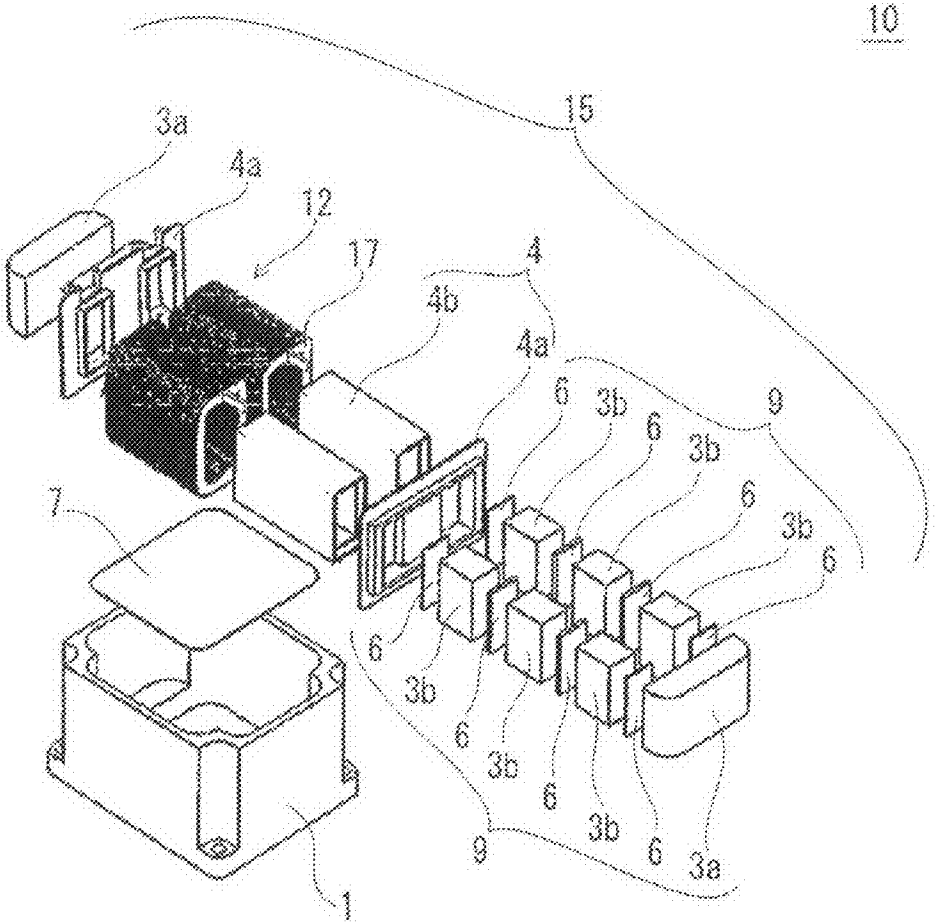
FIG. 2 is an exploded perspective view of the reactor of FIG. 1.
Figure 3:
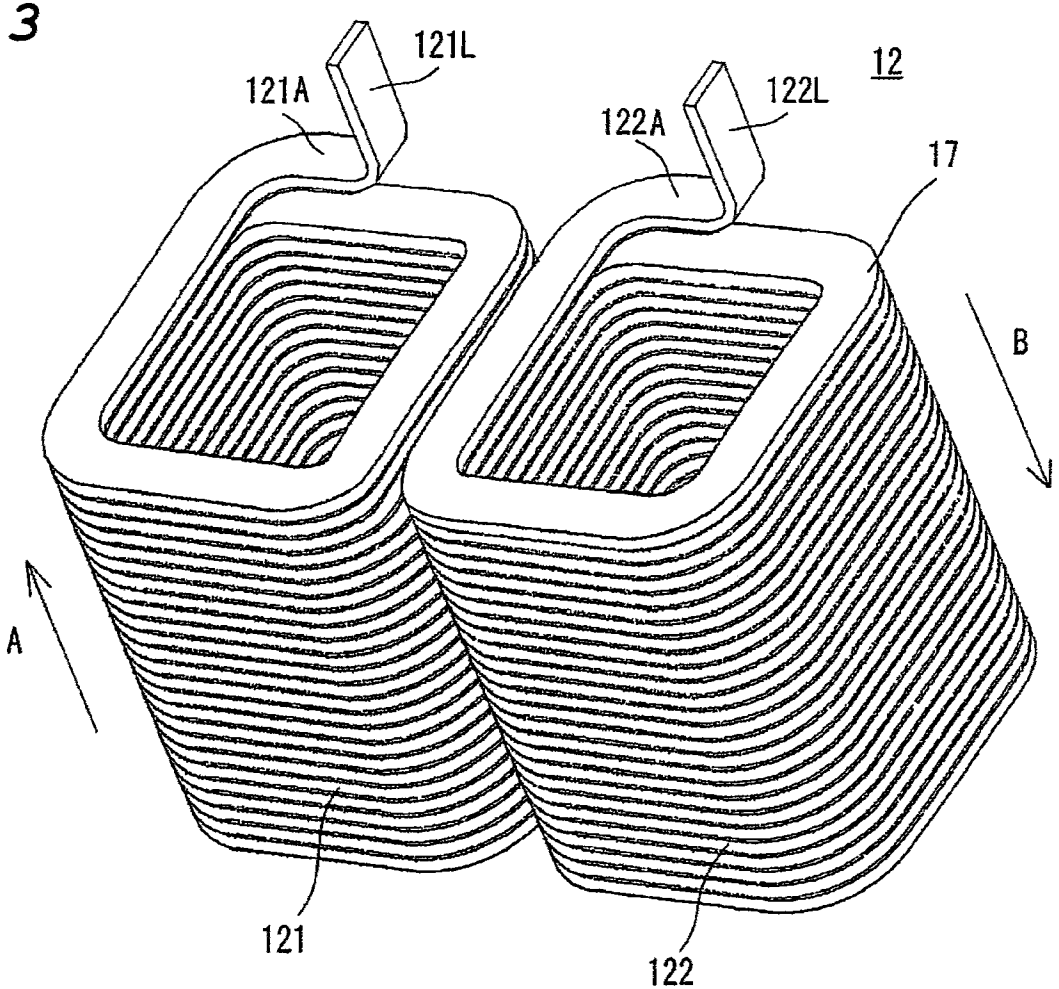
FIG. 3 is a perspective view of the reactor coil according to the embodiment of the present invention.
Figure 4:
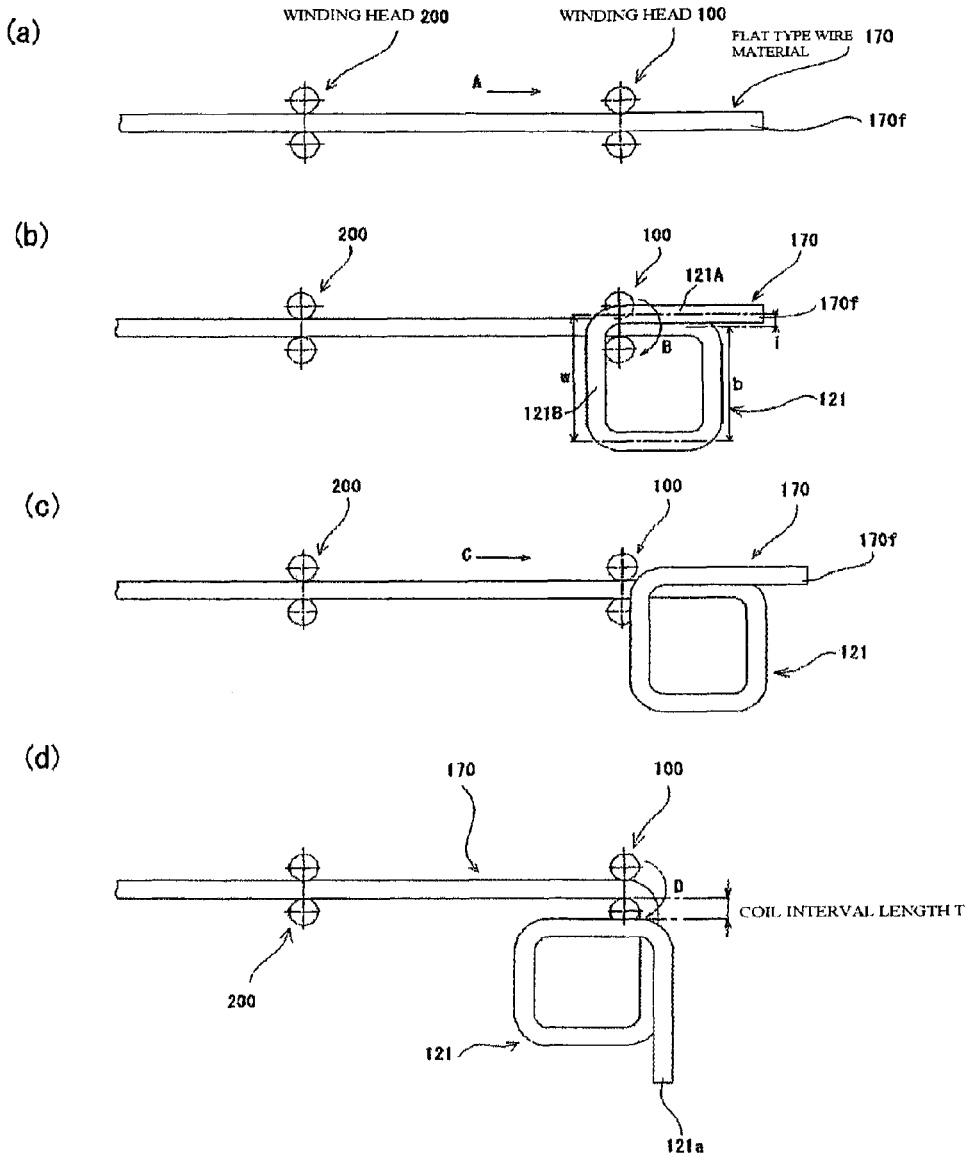
FIG. 4 is the first diagram explaining a method of forming the reactor coil according to the embodiment of the present invention.
Figure 5:
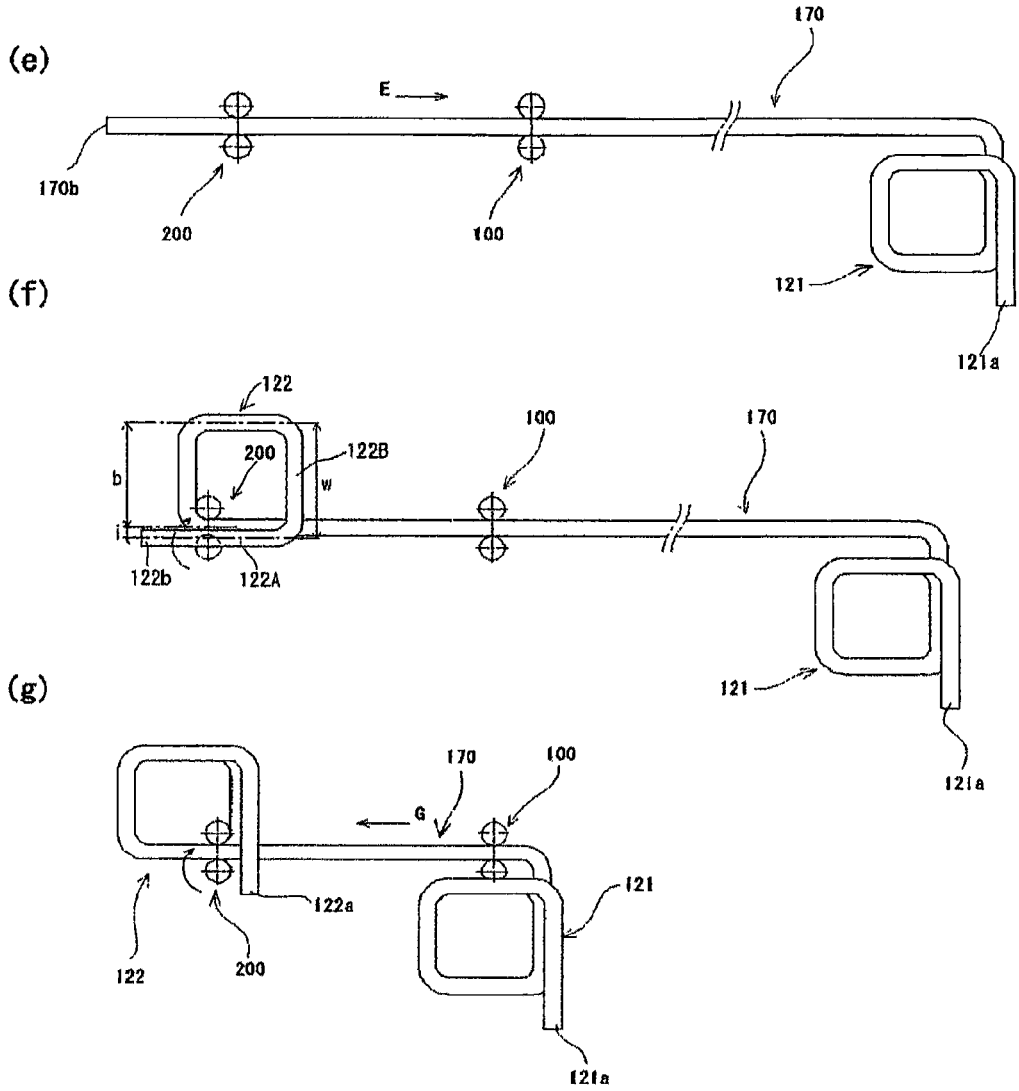
FIG. 5 is the second diagram explaining a method of forming the reactor coil according to the embodiment of the present invention.
Figure 6:
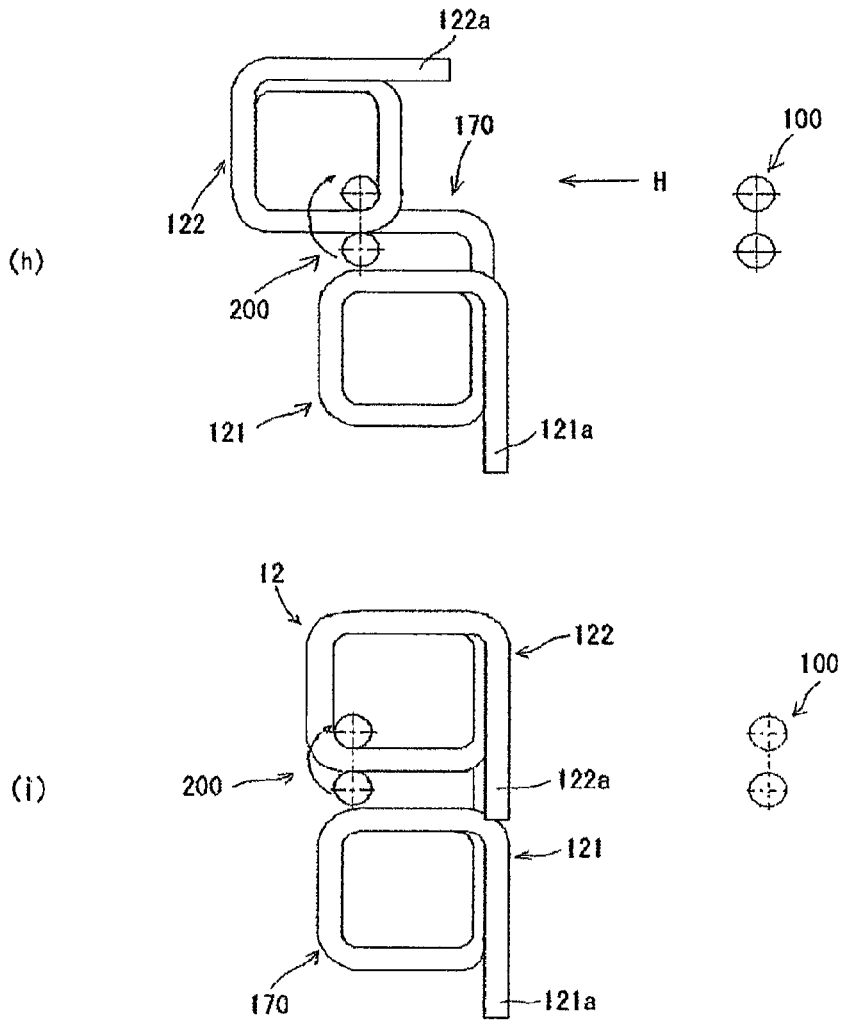
FIG. 6 is the third diagram explaining a method of forming the reactor coil according to the embodiment of the present invention.

1: Thermal conductive case; 4: Bobbin; 7: Insulation/dissipation sheet; 8: Filler; 10: Reactor; 12: Reactor coil; 13: Reactor securing hole; 17: flat type wire; 121L, 122L: Lead portion; 121: First coil element; 122: Second coil element; 100: Winding head; 200: Winding head; 170: flat type wire material

The invention claimed is:

1. A reactor coil, comprising:

first and second coil elements both of which are formed by one piece of rectangular wire rod and each of which is wound rectangularly in an edgewise manner and stacked cylindrically, wherein a winding terminating end point of said first coil element is offset by a predetermined interval and then is bent approximately 90 degrees in a direction opposite to a winding direction of said first coil element such that the rectangular wire rod is stacked in the direction opposite to the winding direction of said first coil element and is wound edgewisely and rectangularly in a direction opposite to the winding direction of said first coil element to form the second coil element such that the first coil element and second coil element are aligned in parallel to each other in a continuous state, and wherein a winding starting end piece of said first coil element and a winding terminating end piece of said second coil element are projected from outer circumferences of said first coil element and said second coil element respectively at same sides of each winding axis of said first and second coil elements, as each other.

2. The reactor coil as claimed in claim 1, wherein said reactor coil is contained in a thermally conductive case which comprises an inner surface containing said reactor coil, said inner surface comprising substantially a plane surface.

3. The reactor coil as claimed in claim 1, wherein the first and second coil elements have rectangular tube shapes.

4. The reactor coil as claimed in claim 1, wherein a cross section of said first coil element, perpendicular to a direction that the winding starting end piece of said first coil element projects from the outer circumference of said first coil element, has a rectangular shape.

5. The reactor coil as claimed in claim 4, wherein, in a cross-sectional view, said second coil element has the rectangular shape.

6. The reactor coil as claimed in claim 5, wherein, in a plan view, the first and second coil elements have the rectangular shape.

7. The reactor coil as claimed in claim 5, wherein each of surfaces of the first coil element, which extends in the direction that the winding starting end piece of said first coil element projects from the outer circumference of said first coil element, comprises a flat plate.

8. The reactor coil as claimed in claim 7, wherein said reactor coil is contained in a thermally conductive case which comprises a flat inner surface containing said reactor coil, the flat plate of one of the surfaces of the first coil element contacting with the flat inner surface of the thermally conductive case.

9. The reactor coil as claimed in claim 8, wherein each of surfaces of the second coil element, which extends in the direction that the winding starting end piece of said first coil element projects from the outer circumference of said first coil element, comprises a flat plate.

10. The reactor coil as claimed in claim 9, wherein the flat plate of one of the surfaces of the second coil element contacts the flat inner surface of the thermally conductive case.

11. The reactor coil as claimed in claim 1, wherein the winding starting end piece of said first coil element and the winding terminating end piece of said second coil element are located at a predetermined distance from a reactor core inserted in the reactor coil.

12. The reactor coil as claimed in claim 11, wherein the winding starting end piece of said first coil element and the winding terminating end piece of said second coil element are insulated from the reactor core without an insulation member interposed between the reactor core and each of the winding starting end piece of said first coil element and the winding terminating end piece of said second coil element.

13. The reactor coil as claimed in claim 1, wherein the winding starting end piece of said first coil element and the winding terminating end piece of said second coil element are located at a same side of the first and second coil elements.

* * * * *